United States Patent [19]

McKrell et al.

[11] Patent Number: 4,643,090

[45] Date of Patent: Feb. 17, 1987

[54] PRINTING PRESS AND METHOD

[75] Inventors: Richard L. McKrell, Ledyard; W. Robert Gelinas, Jewett; Yakov Z. Brovman, Mystic, all of Conn.

[73] Assignee: Harris Graphics Corporation, Melbourne, Fla.

[21] Appl. No.: 705,640

[22] Filed: Feb. 26, 1985

[51] Int. Cl.[4] ..... B41F 5/12; B41F 13/20; B41F 13/40

[52] U.S. Cl. ..... 101/218; 101/220; 101/247

[58] Field of Search ..... 101/174, 176, 177, 179, 101/180, 182, 184, 185, 220, 217, 137–141, 218, 247, 143–145; 100/163 R, 163 A, 164, 168, 169, 170, 171, 176

[56] References Cited

U.S. PATENT DOCUMENTS

| | | | |
|---|---|---|---|
| 3,016,819 | 1/1962 | Kupka | 100/163 R |
| 4,132,166 | 1/1979 | Bugnone | 101/247 |
| 4,141,293 | 2/1979 | Corse | 101/247 |
| 4,200,045 | 4/1980 | Toropainen | 101/217 |
| 4,369,705 | 1/1983 | Gelinas | 101/218 |
| 4,458,590 | 7/1984 | Egnaczak et al. | 101/247 |

*Primary Examiner*—J. Reed Fisher
*Attorney, Agent, or Firm*—Yount & Tarolli

[57] ABSTRACT

A printing press includes an improved method and apparatus for moving printing cylinders between thrown off positions in which bearers connected with the cylinders are separated and thrown on or printing positions. The printing cylinders are urged to their thrown off positions by springs which, in one embodiment of the invention, apply a biasing force to pivotally mounted support arms for the cylinders. In another embodiment of the invention, the cylinders are mounted on cantilevered leaf springs which urge the cylinders toward their thrown off positions. A motor is provided to apply a force directly to one of the printing cylinders to move it from its thrown off position to its printing position. The other printing cylinders are moved from their thrown off positions to their printing positions under the influence of forces transmitted between bearers connected with the printing cylinders.

6 Claims, 8 Drawing Figures

PRINTING PRESS AND METHOD

BACKGROUND OF THE INVENTION

1. Field of the Invention

The present invention pertains generally to printing units of a printing press and more particularly to an improved system for mounting the cylinders of such printing units.

2. Description of the Prior Art

Conventional web offset perfecting printing units include two printing couples, each couple comprising a plate cylinder and a blanket cylinder. The plate cylinder of each couple is disposed in rolling engagement with the blanket cylinder whereby it transfers an ink impression onto a blanket cylinder. The blanket cylinder, in turn, transfers the ink to the web material with which it is in rolling contact in the form of a printed image. The second printing couple likewise includes a second plate cylinder and a second blanket cylinder which prints on a second side of the web of material simultaneously with the printing on the first side by the first blanket cylinder.

As is well known, it is necessary for purposes of accessibility as in changing plates and during web breakage and paper wrapup, to separate or "throw off" the printing cylinders. To that end, it has been common practice as disclosed, for example, in U.S. Pat. No. 2,874,636, to mount at least one cylinder of each printing couple, and generally three of the four cylinders in throw offs comprising a complicated system of eccentrics, bearings, levers and links. In order to maintain the degree of blanket pressure required to produce a quality printing job, it has been necessary to precisely maintain the positions of the cylinders. This was accomplished in prior art devices by using very stiff mounting mechanisms, requiring the eccentric boxes and cylinder bearing housings to be precisely machined and thus very expensive.

As will be hereinafter explained, such stiff mounting mechanisms are subjected to severe stresses during the printing operation with resultant high maintenance costs and excessive down time. Maintenance of precise cylinder positioning has been greatly facilitated by the addition of cylinder bearer supports as taught, for example, in U.S. Pat. No. 3,256,812. Such bearer supports or rings are fitted to the shafts of the cylinders and are of such diameter relative to that of the associated cylinders that the bearer rings of one cylinder rotate in engagement with the bearer rings of an adjacent cylinder when the cylinders are in the "thrown on" or printing position. The bearer rings serve, among other things, to regulate the spacing between the cylinders without creation of excessive pressure between the cylinder surfaces themselves. By interconnecting the adjacent cylinders, the bearer rings have significantly improved the stability of color register, assisted in defining proper blanket squeeze and, particularly in single-width presses with hollow cylinders, markedly reduced cylinder bouncing which is the major cause of streaking.

While the addition of bearer rings in the aforedescribed manner represented a significant advance in this phase of the printing art, the improved device did not entirely avoid the problems encountered in support of the cylinders in that the stiff bearing supports, wherein pre-loading is applied through the cylinder bearing housings, were still employed. The use of stiff or rigid bearing supports in combination with stiff bearer links or rings tends to be self-destructive inasmuch as the arrangement is very sensitive to bearing and/or bearer eccentricities or runouts. As the stiffness of the supports is increased, the potential for greater sprious forces of self-destruction are introduced.

It is believed the major cause of large runouts is severe web wrapup following web breakage. The wrapup results in relatively large residual deformation of bearing and bearer ring surfaces as well as bending of the cylinder journals. With the degree of stiffness or rigidity required in the bearing supports of such a system to achieve the desired bearer precompression and blanket squeeze, severe web wrapups results in irrevocable loosening of bearings leading, in turn, to bearer separation. The bearers thus become idle or ineffective since their function is to operate in rolling engagement with one another and thereby establish and maintain proper cylinder position and blanket pressure.

SUMMARY OF THE INVENTION

In accordance with the present invention, a printing press includes an improved method and apparatus for moving printing cylinders between thrown off positions in which bearers connected with the cylinders are separated and thrown on or printing positions. The printing cylinders are urged to their thrown off positions by springs which, in one embodiment of the invention, apply a biasing force to pivotally mounted support arms for the cylinders. In another embodiment of the invention, the cylinders are mounted on cantilevered leaf springs which urge the cylinders toward their thrown off positions. A motor is provided to apply a force directly to one of the printing cylinders to move it from its thrown off position to its printing position. The other printing cylinders are moved from their thrown off positions to their printing positions under the influence of forces transmitted between bearers connected with the printing cylinders.

When the motor is operated to effect movement of the printing cylinders from their thrown off positions to their printing positions, a first one of the printing cylinders is moved from its thrown off position to a position in which the bearers connected with the first printing cylinder are in abutting engagement with the bearers connected with a second printing cylinder. Continued operation of the motor moves the first and second printing cylinders together away from their thrown off positions to a position in which the bearers connected with the second printing cylinder are in abutting engagement with the bearers connected with a third printing cylinder. Still further operation of the motor moves the first, second and third printing cylinders together away from their thrown off positions until the cylinders are in their printing positions.

Since all but one of the printing cylinders are moved by abutting engagement between bearers connected with the printing cylinders, the use of relatively stiff or rigid bearing supports is eliminated. In addition, the use of a single motor to apply force to one of the printing cylinders to move the other printing cylinders eliminates the relatively stiff bearer links and/or rings which have previously been used in printing presses. In the event of a wrapup, the application of predetermined forces to the printing cylinders enables them to be moved against the influence of the motor and biasing springs to relieve the forces encountered during the wrapup without damaging the printing press.

Accordingly, it is an object of this invention to provide a new and improved printing press in which printing cylinders are movable from their thrown off positions to their printing positions under the influence of forces transmitted directly between bearers for the printing cylinders.

Another object of this invention is to provide a new and improved method of moving printing cylinders between thrown off and printing positions and in which the printing cylinders are moved from their thrown off positions to positions in which bearers connected with the printing cylinders are in abutting engagement and, wherein, the printing cylinders are then moved together, away from their thrown off positions with their bearers in engagement until they are in their printing positions.

BRIEF DESCRIPTION OF THE DRAWINGS

In the drawings, wherein like numerals are employed to designate like parts through the same.

DESCRIPTION OF THE PREFERRED EMBODIMENTS

Figure 1:
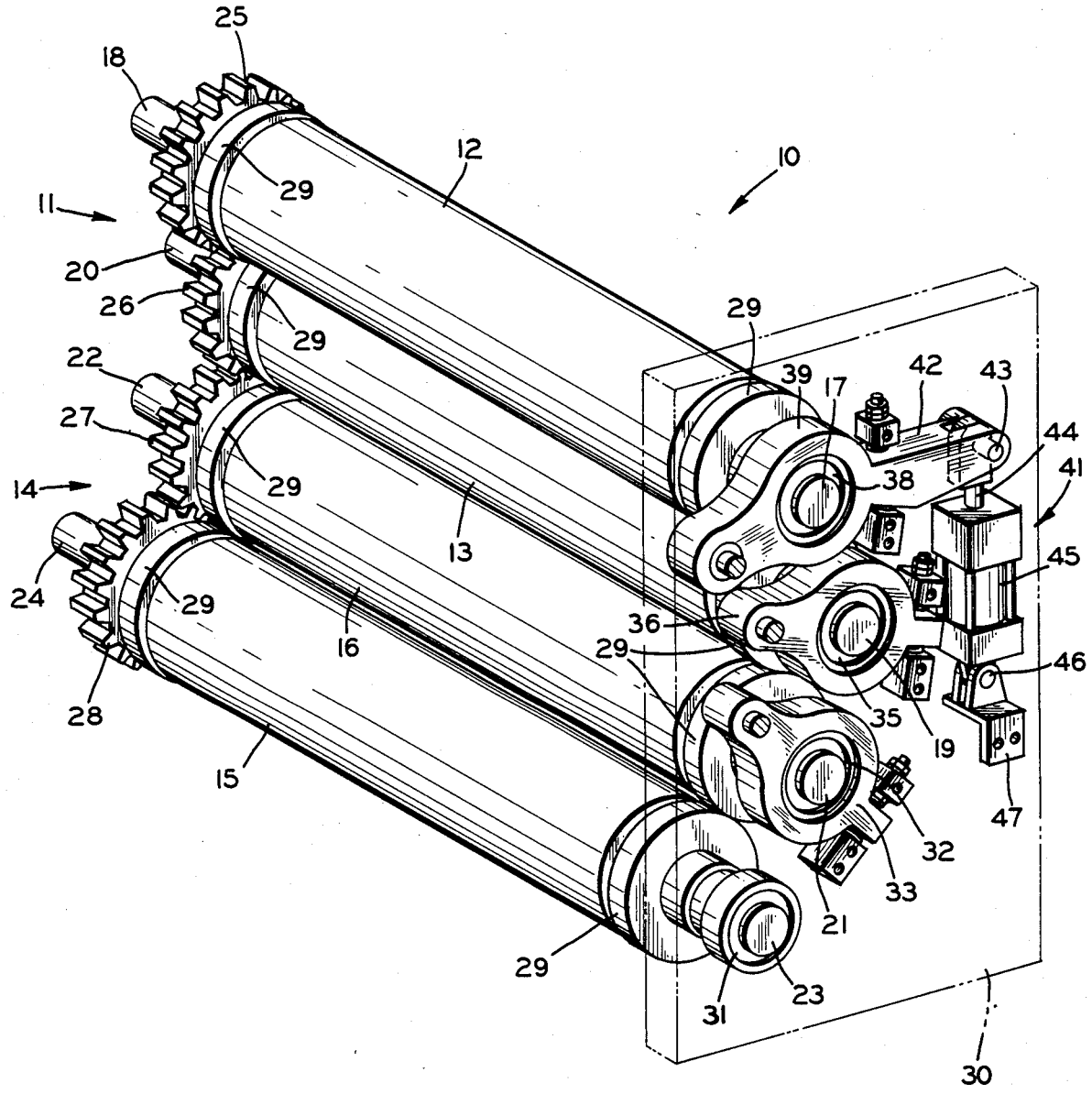
FIG. 1 is a fragmentary perspective view of a printing unit of a perfecting rotary offset press embodying the invention, the cylinders being shown in their printing positions.

Referring now to the drawings, and in particular to FIG. 1, there is shown a portion of an offset, lithographic perfecting printing press 10 constructed in accordance with the invention. Such presses conventionally comprise an upper printing unit 11 including a top plate cylinder 12 and a cooperating top blanket cylinder 13, and a lower printing unit 14 including a bottom plate cylinder 15 and a bottom blanket cylinder 16. A web of material to be printed (not shown) is fed between the counterrotating blanket cylinders 12 and 14 in a left-to-right direction as viewed in FIGS. 1 to 3 so as to be printed on both surfaces in conventional fashion. As will be more fullY described hereinafter, suitable inkers and dampeners are employed in conjunction with the top and bottom plate and blanket cylinders to complete the upper and lower printing units.

The cylinder 12 includes stub shafts 17 and 18 at its opposite ends by means of which it is mounted for rotation about its longitudinal axis. Likewise, the blanket cylinder 13 includes stub shafts 19 and 20, the bottom plate cylinder 15 has stub shafts 21 and 22, and the bottom blanket cylinder 16 has stub shafts 23 and 24, by which they are mounted for rotation about their respective longitudinal axes. Affixed to the stub shafts 18, 20, 22 and 24 are gears 25, 26, 27 and 28, respectively, for driving the associated cylinders as by means of a drive unit (not shown) in driving engagement with one of the aforementioned gears. The teeth of the gears 25 through 28 are of such depth that the gears remain intermeshed so as to be capable of driving the cylinders when in the throw off mode, as well as while the cylinders are in the throw on operating configuration. Bearer rings 29 are located at the ends of each of the cylinders 12 through 15, with the bearer rings at each end being aligned and of a diameter relative to their associated cylinder such that the bearer rings of one cylinder rotate in engagement with the bearer rings of the next adjacent cylinder or cylinders when the cylinders are in the throw on, printing position.

In accordance with a preferred embodiment of the invention as illustrated in FIGS. 1 to 5, the cylinders 12, 13 and 16 are supported, at their ends by a frame of the press, a fragment of the frame being shown generally at 30. More particularly, the stub shafts 23 and 24 of the bottom plate cylinder 15 are mounted in journals 31 carried by the frame 30. Therefore the central axis of the cylinder is in a generally fixed position. It will be appreciated that while for purposes of simplification and clarity, the mounting arrangement has been illustrated and will be discussed for only one end of the cylinders, a generally identical arrangement is also provided at the opposite end.

Figure 2:
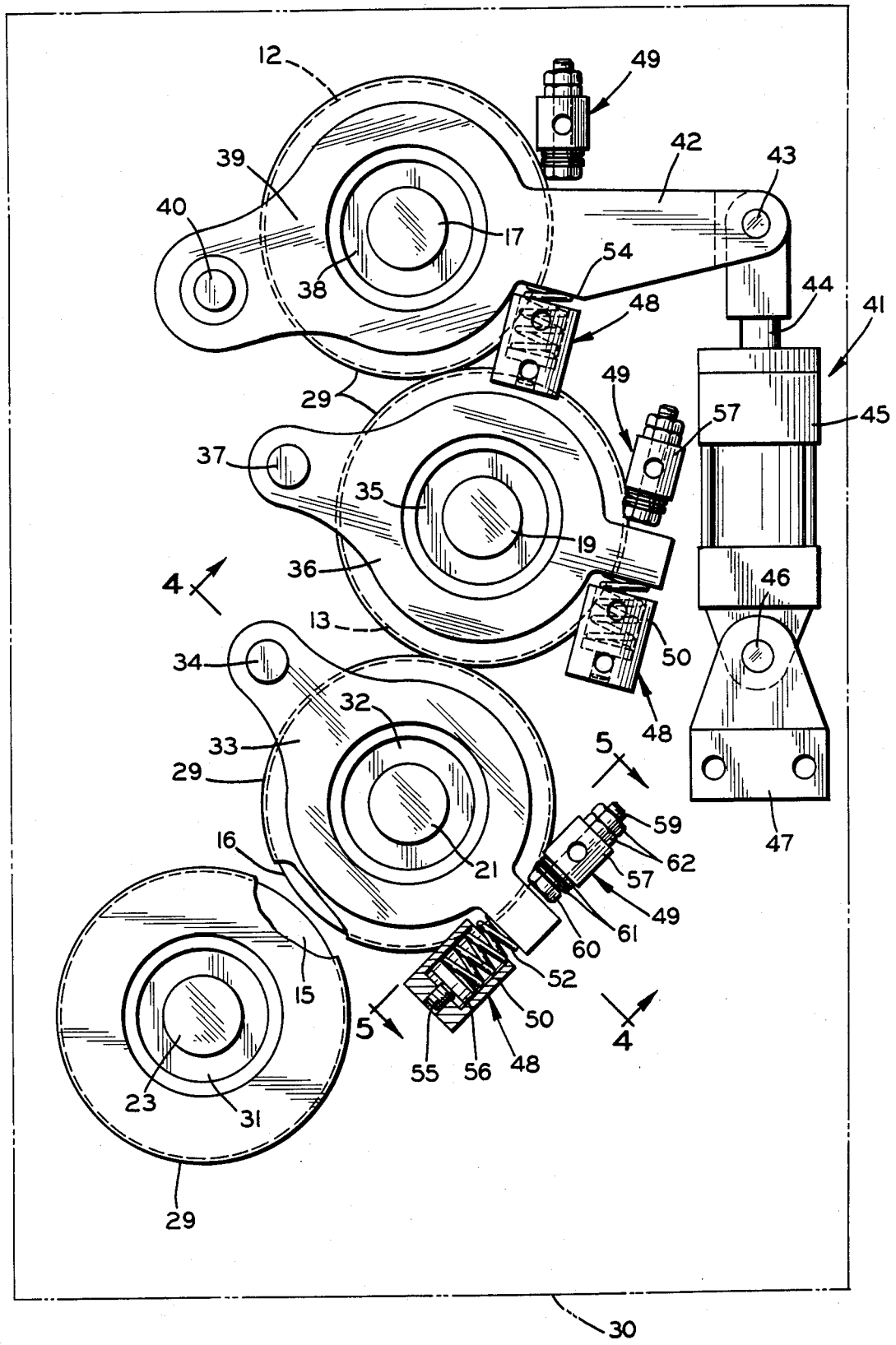
FIG. 2 is an elevational side view of the embodiment of FIG. 1.
Figure 3:
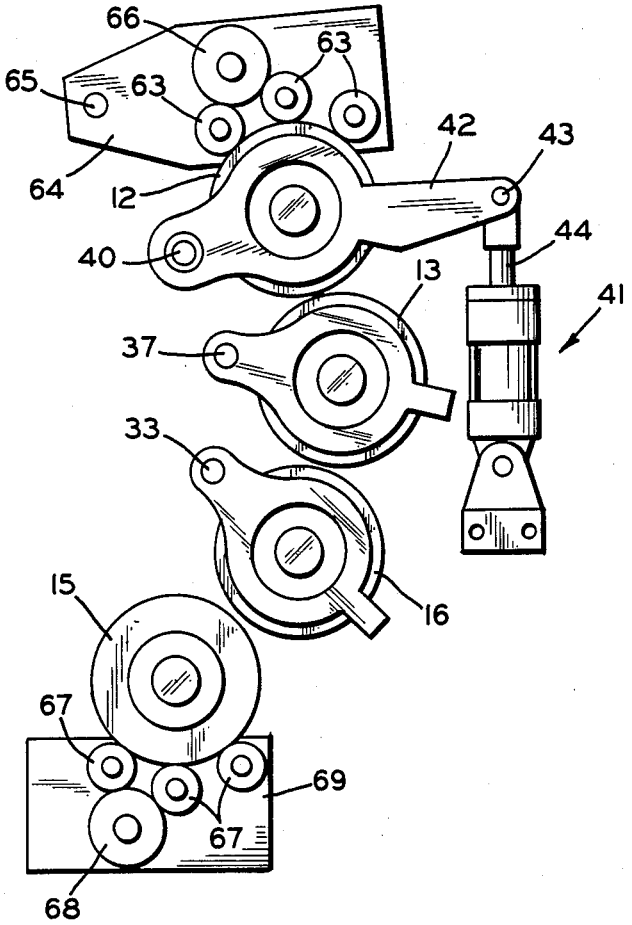
FIG. 3 is an elevational side view of the embodiment of FIG. 1, showing the mechanism in the throw off position, and further illustrating the inker rolls mounted for floating engagement with the top plate cylinder.

In order to provide for pressure loading of the cylinders and to permit throw off of the cylinders from one another, opposite axial ends of the top plate cylinder 12 and the top and bottom blanket cylinders 13 and 16 are carried by pivotal support members or arms, as best shown in FIGS. 1 to 3 for one of the axial ends of the cylinders. It should be understood that although only the mounting arrangement for the right (as viewed in FIG. 1) ends of the cylinders have been shown in FIG. 1, the left ends of the cylinders are supported in the same manner as the right ends.

More particularly, the stub shafts 21 and 22 of the bottom blanket cylinder 16 are mounted in journals 32 carried by pivot or swing arms 33 pivotally supported upon the frame 30 by pins 34. Likewise, the stub shafts 19 and 20 of the top blanket cylinder 13 are mounted in journals 35 carried by pivot or swing arms 36 pivotally supported upon the frame 30 by pins 37. The stub shafts 17 and 18 of the top plate cylinder 12 are received in journals 38 carried by pivot or swing arms 39 pivotally supported at the frame 30 by pivot pins 40. The arms 33, 36 and 39 are thus free to swing about the pivot pins within the limits whereby the cylinders 16, 13 and 12, respectively, can move between the throw on and throw off positions as will be hereinafter explained. Although only the arms 33, 36 and 39 at one side of the printing press have been shown in FIGS. 1 and 2, similar arms are located at the opposite side of the printing press.

Compression of the cylinder stack is provided by means of a pair of pressure cylinder units, one of which is shown at 41, at each end of the cylinder stack. To that end, the cantilever arms 39 include extensions 42 whose outer ends are pivotally connected at 43 to the piston rods 44 of cylinders 45. The cylinders are connected at their opposite ends by pins 46 to brackets 47 affixed to the frame 30. The cylinders 45 may be of a conventional air or hydraulic type wherein by application of appropriate pressure to the working fluid, the piston will be urged inwardly or retracted to, in turn, maintain a desired downward force upon the cantilever arm 39 as will be hereinafter described. Although only the cylinder unit 41 at the right end of the plate cylinder 12 has been shown in FIGS. 1 and 2, a similar cylinder unit is disposed at the opposite end of the plate cylinder.

Throw off or separation of the cylinders 12, 13 and 16 is accomplished by means of spring assemblies or retractors, illustrated generally at 48 in FIG. 2, acting against the cantilever arms 39, 36 and 33, respectively, to urge the arms to pivot upwardly about their respective pivot pins 34, 37 and 40 when the compression force of the pressure cylinder units 41 is reduced or removed. Adjustable stops 49 are provided opposite the retractors 48 for defining the upper limit of movement of the cantilever arms 50 so that the throw on and throw off positions of the cylinders will be within prescribed limits. It should be understood that retractors and stops, corresponding to the retractors and stops 48 and 49, are associated with the opposite ends of the printing cylinders 12, 13 and 16.

Figure 5:
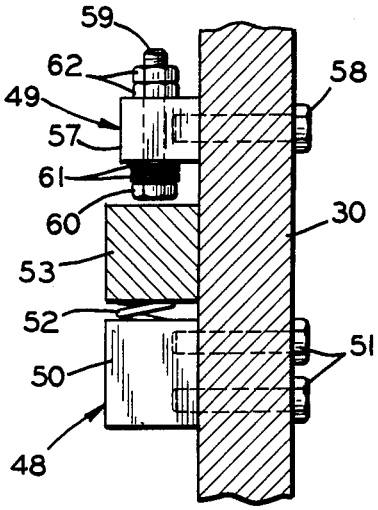
FIG. 5 is a fragmentary sectional view taken substantially along line 5—5 of FIG. 2.

More particularly, the retractors 48 comprise an open ended tubular bracket 50 affixed to the frame 30 as by bolts 51 (FIG. 5). A compression spring 52 within the tubular bracket bears against a flange 53 on the cantilever arms 33 or 36 or a planar segment 54 on the extension 42 of the cantilever arm 39 to urge the arms upwardly. Adjustment of the force of the compression spring against the arm is provided by means of a threaded insert 55 (FIG. 2) in the bottom of the tubular bracket having a platform 56 bearing against the bottom of the spring. By turning the insert as with an Allen wrench the platform can be moved up or down within the tubular bracket to vary the effective force of the spring.

The adjustable stops 49 include a tube 57 affixed to the frame 30 as by a stud 58. A bolt 59 extends through the tube with its head 60 adapted for engagement of the tops of the flanges 53 or extension 42 of the cantilever arm 39 as the case may be. Belleville springs 61 are provided on the bolt 59 between the head and the bottom of the tube 57, and jam nuts 62 are threaded on the bolt by means of which a predetermined compressive force can be established and maintained in the springs. For example, the springs may be precompressed to a force of five hundred pounds, that is, the top would resist a force of up to five hundred pounds applied to the head 60 by the flange 53, and would then yield if a greater force were applied. As will be appreciated, this feature may be important in preventing creation of excessive forces upon the cylinders in the event of a web wrapup.

It is desirable that the inker rolls remain in rolling contact with the top and bottom plate cylinders when the cylinders are in the throw off configuration. To that end, there is illustrated in FIG. 3 a feature of the invention whereby the inker rolls for the top plate cylinder 12 are in floating engagement with the cylinder. The bottom plate cylinder 15 does not, of course, move during throw off so that the inner rolls therefore can be mounted in the customary stationary manner.

The required number of top ink form rolls 63, three such rolls being shown in the embodiment of FIG. 3, are journalled at their ends in side plates 64 pivotallY supported at 65 upon a segment of the press frame 30. One or more ink vibrators 66 may also be journalled in the side plates for engagement with the ink form rolls in the customary fashion. Ink form rolls 67 and an ink vibrator 68 are journalled in side plates 69 which may be affixed to the press frame 30 so that the form rolls 67 will be in rolling engagement with the stationary bottom plate cylinder 15. The top ink form rolls 63, inasmuch as they are carried by the pivotally mounted side plates 64, operate in floating engagement with the top plate cylinder 12. The plate cylinder 12 and blanket cylinders 13 and 16 are illustrated in FIG. 3 in their throw off position wherein the precompressing force of the pressure cylinder units 41 has been released and the cantilever arms carrying the cylinders have been urged upwardly by the retractors 48 into engagement with their respective stops 49. As the plate cylinder 12 moves between the throw on position of FIGS. 1 and 2 and the throw off position of FIG. 3, the ink form rolls 63 likewise move and remain in operative engagement with the plate cylinder.

As will be apparent, the cylinder mounting mechanism of the present invention is particularly well adapted to the mounting of the plate and blanket cylinders with their axes in linear alignment or near linear alignment as opposed to the offsetting of the cylinders which is necessary to accommodate throw off movement of cylinders mounted in conventional eccentrics. Thus, it will be appreciated that while the cylinders 12, 13, 15 and 16 of the embodiment of FIGS. 1 to 3 have been illustrated with their longitudinal axes offset, they could be mounted in vertically aligned relationship where desired for purposes of conserving space and providing improved accessibility as in presses employing a plurality of such printing units in series.

The lower plate cylinder 15 is mounted for rotation about a fixed axis. However, if desired, the lower plate cylinder could be pivotally mounted in the same manner as the cylinders 12, 13 and 16. If this was done, the lower inker rollers 67 and 68 would be pivotally mounted in the same manner as the upper inker rollers.

Figure 7:
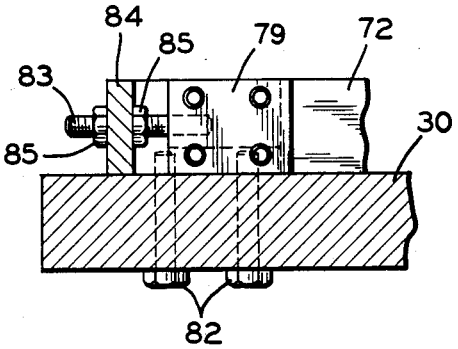
FIG. 7 is a fragmentary view, partially in section, taken substantially along line 7—7 of FIG. 6.
Figure 4:
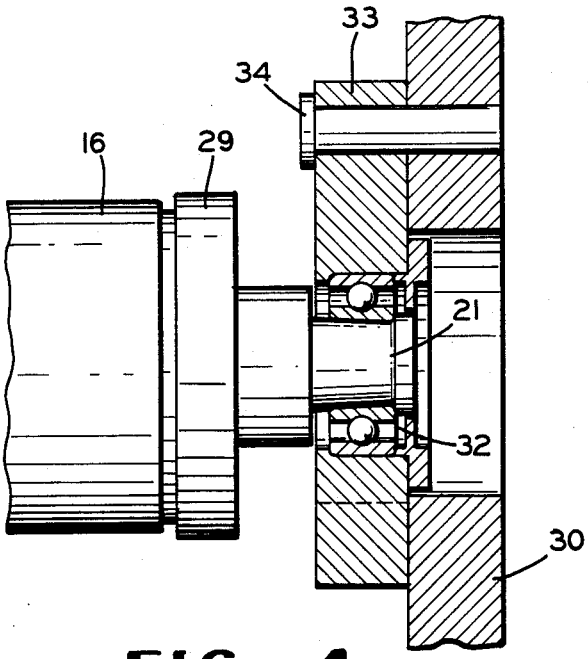
FIG. 4 is a fragmentary view, partially in section, taken substantially along line 4—4 of FIG. 2.
Figure 8:
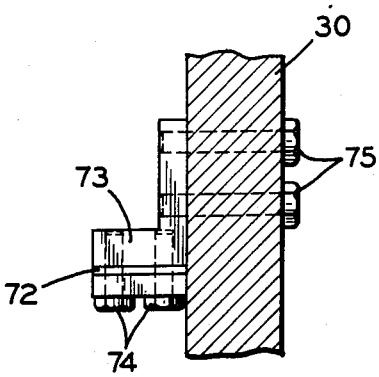
FIG. 8 is a fragmentary view, partially in section, taken substantially along line 8—8 of FIG. 6.
Figure 6:
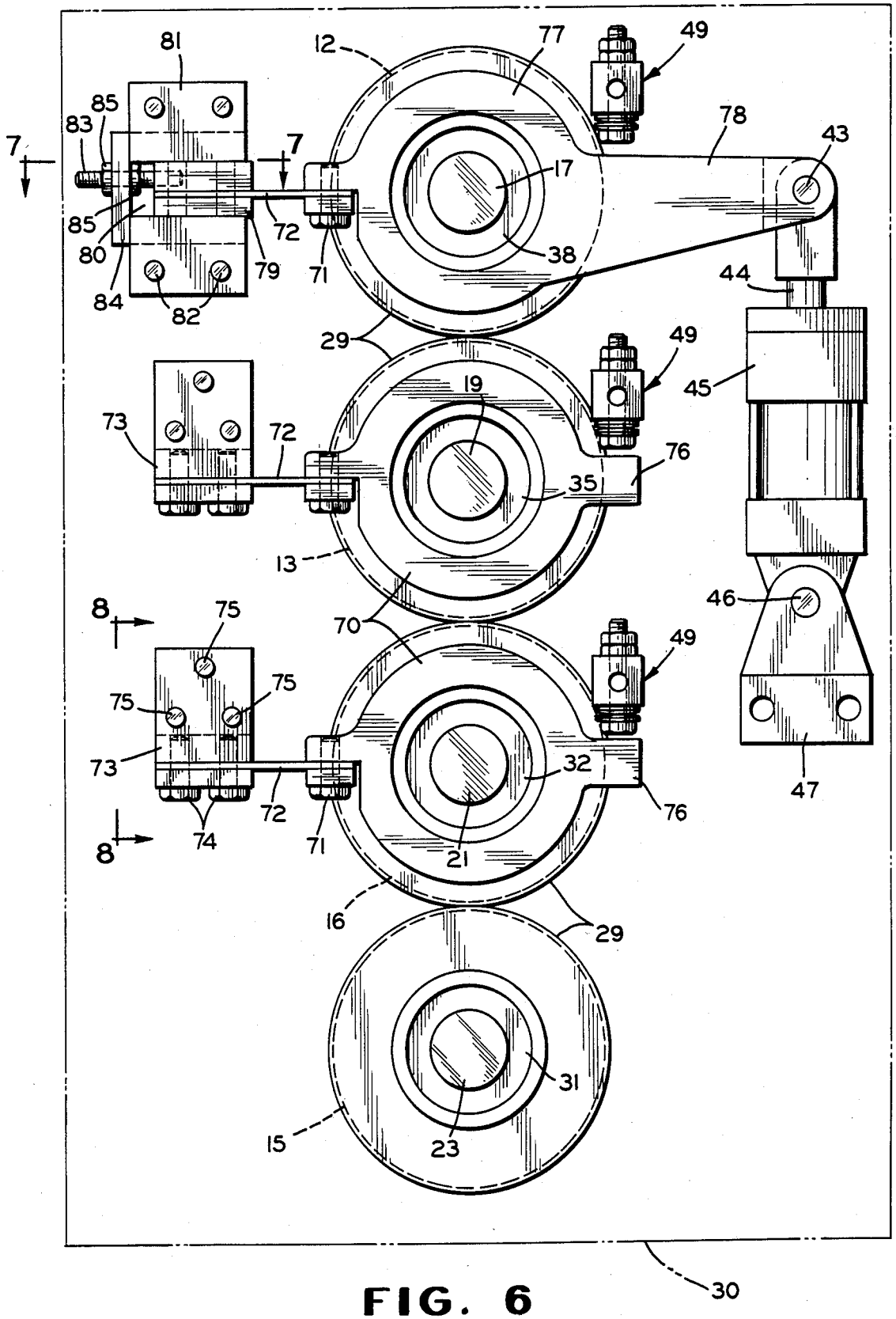
FIG. 6 is a side elevational view, similar to that of FIG. 2, illustrating another embodiment of the invention.

There is illustrated in FIGS. 6 through 8 an embodiment of the invention employing an alternate form of cantilever support for the plate and blanket cylinders 12, 13, 15 and 16, the cylinders being arranged in a vertically aligned configuration. In other respects the embodiment is identical to that of FIGS. 1 to 5 and accordingly, where appropriate, like numerals are employed to designate like parts. In the alternate embodiment the journals 31 for the bottom plate cylinder 15 are again carried by the press frame 30 with the cylinder being in a generally fixed position. The web cylinders 13 and 16 and top plate cylinder 12 are carried in cantilever fashion for throw off. To that end the journals 32 of the bottom blanket cylinder 16 are mounted in journal boxes 70 affixed as by fasteners 71 to the end of a leaf spring member 72. The other end of the leaf spring member is clamped in a bracket clamp 73 by fasteners 74, the bracket clamp being affixed to the frame 30 as by studs 75.

The leaf spring members 72 are so constructed as to urge the journal boxes upwardly so that when the compression force is not applied through the bearer rings 29, the cylinder 16 will move upwardly to the throw off position. The journal boxes 70 include a flange 76 which engages the adjustable stops 49 to limit the upward movement of the cylinder. As will be readily apparent, the top blanket cylinder 13 may utilize a mounting system identical to that for the bottom blanket cylinder 16. Although only the leaf spring members for the right side of the printing press have been shown in FIG. 6, it should be understood that similar leaf spring members are disposed on the left side of the printing press. The leaf spring members on the left side of the printing press are connected with the printing cylinders in the same manner as shown in FIG. 6.

The system for mounting the top plate cylinder is generally similar except that the journal box 77 includes an extension 78 which is pivotally connected at 43 to the piston rod 44. The top of the extension engages the stop 49 to limit the upward travel in the throw off position. In order to provide for limited lateral adjustment of the plate cylinder, the leaf spring members 72 are suitably secured between segments of guides 79 (FIGS. 6 and 7) slidably received in slots 80 of brackets 81 affixed to the frame 30 as by studs 82. Threaded adjusting members 83 affixed to the guides 79 extend through a plate 84 on the bracket. Nuts 85 on the adjusting member 83 on either side of the plate 84 may be appropriately manipulated to move the guides along the slots and thereby adjust the lateral and skew positions of the plate cylinder 12 relative to the blanket cylinder 13.

When the motor 45 of FIG. 6 is in an inactive condition, the leaf springs 72 are effective to move the cylinders 12, 13 and 16 to their thrown off positions, corresponding to the positions shown in FIG. 3. At this time, the bearers 29 are spaced apart and the extenisons 76 and 78 engage the stops 49 to locate the cylinders 12, 13 and 16 in their thrown off positions. Upon operation of the motor 45, the cylinders 12, 13 and 16 are forced downwardly to their printing positions (FIG. 6) against the influence of the leaf springs 72.

Reviewing briefly operation of the invention and in particular the embodiment of FIGS. 1 to 3, when the cylinders 12, 13, 15 and 16 are to be placed in the throw on, printing position, the working fluid in the pistons 45 is pressurized to thereby retract the piston rods 44 and pivot the cantilever arms 39 downwardly about the pivot pins 40. The planar segments 54 on the extensions 42 of the cantilever arms thus compress the springs 52 of the retractors 48, and the top plate cylinder moves downwardly so that its bearer rings 29 engage the bearer rings of the top blanket cylinder 13. This causes the cantilever arms 36 to pivot downwardly with the flanges 53 compressing the springs 52 of the associated retractors 48, and the bearer rings 29 of the top blanket cylinder to engage the bearer rings 29 of the bottom blanket cylinder 16. Continued retraction of the piston rod 44 causes the cylinder 16 and cantilever arms 33 by which it is carried to pivot downwardly so that the flanges 53 compress the springs 52 and the bearer rings engage the bearer rings 29 of the bottom plate cylinder 15. Meanwhile the ink form rolls 63, since they are pivotally supported in floating engagement with the top plate cylinder 12, remain in continuous operative engagement with the top plate cylinder. The bottom plate cylinder 15 is mounted in a fixed position and thus also is in continuous operative engagement with the bottom ink form rolls 67.

It will thus be apparent that by retracting the piston rods 44 and maintaining an appropriate pressure in the working fluid of the cylinders 45, a predetermined desired level of pressure loading of the cylinders may be maintained. The preloading force is transmitted through the bearer rings from one cylinder to the next thereby eliminating the possibility of creation of excessive forces upon the journals by which the cylinders are carried. Should web breakage and wrapup occur, resulting in forces between the cylinders which are greater than the predetermined safe preloading force produced by the pressure on the working fluid of the cylinder 45, the cylinders will simply separate or move apart to accommodate the wrapup without creating excessive forces within the cylinder mechanism which might result in permanent deformation of the cylinders or their supports. When the wrapup is removed, the cylinders return to their normal operating positions with the bearer rings of adjacent cylinders in rolling engagement with one another. Should the cylinders be forced apart sufficiently that their cantilever arms engage the heads 60 of the stops 49, the Belleville springs 61 will absorb the movement and permit additional separation before the force upon the cylinder stack becomes excessive.

In order to throw off the clinders, the pressure within the working fluid of the power cylinders 45 is simply relieved, removing the downward force upon the cantilever arm 39. The retractors 48 then urge the cantilever arms 33, 36 and 39 upwardly until the flanges 53 or extensions 42 engage the stops 49, whereupon the cylinders 12, 13, 15 and 16 and the bearer rings 29 therefore will be separated. Although the cylinders are separated, the gears 25 through 28 remain intermeshed so that the cylinders can continue to be driven. It should be noted that in order for the cylinders to separate by the desired amounts, it is necessary for the stops 49 to permit cumulative incremental movement of the cantilever arms. Thus, the stop 49 for the top blanket cylinder 13 must accommodate the throw off of the bottom blanket cylinder 16 as well as its own throw off, while the stop 49 for the top plate cylinder 12 must accommodate its own throw off as well as that of the blanket cylinders 13 and 16.

Operation of the embodiment of FIG. 6 is generally identical to that of the above-described embodiment, the only difference being that throw off of the cylinders is accomplished by means of the leaf spring members 72 instead of the compression springs 52 of the retractors 48.

It will thus be apparent that among the many advantages of the present invention over the prior art as typified by the disclosures of the aforementioned U.S. Pat. Nos. 2,874,634 and 3,256,812, as well as U.S. Pat. Nos. 1,482,355, 1,423,792, and 3,561,359, are the ability to utilize standard journals for the mounting of an in-line stack of cylinders without requiring specially machined eccentrics, the ability to establish and maintain a desired pre-loading of the cylinder stack, and to withstand repeated web wrapups without permanent damage to or destruction of the cylinders and their supports. Inasmuch as the heavy, rigid supports and precisesly machined eccentrics are eliminated, changing of cylinders when necessary is also greatly facilitated. In this regard, it will be appreciated that while shown in block form in the drawings, the frame 30 may assume any of the various skeleton forms which will simplifly maintenance and changing of the cylinders.

In view of the foregoing description it is clear that when the printing cylinders 12, 13, 15 and 16 are in the thrown off condition of FIG. 3, the stops 49 engage the pivot or swing arms 33, 36 and 39 so that the distance between the bearers 29 for each of the printing cylinders is the same. Upon operation of the motor unit 41 to move the printing cylinders from the thrown off positions shown in FIG. 3, a force is applied directly to the swing arm 39 which supports the upper plate cylinder 12. This force causes the plate cylinder 12 to move downwardly toward the blanket cylinder 13 against the influence of the spring assembly 48 which engages the extension 42 of the swing arm 39. The other printing cylinders 13 and 16 remain in the thrown off positions shown in FIG. 3 while the upper plate cylinder 12 moves downwardly toward the upper blanket cylinder 13.

When the bearers 29 for the upper plate cylinder 12 engage the bearers 29 for the upper blanket cylinder 13, both the upper plate cylinder 12 and the upper blanket cylinder 13 move downwardly away from their thrown off positions against the influence of spring biasing assembly 48 for the cylinders 12 and 13. Continued operation of the motor unit 41 causes the bearers 29 for the upper blanket cylinder 13 to engage the bearers 29 for the lower blanket cylinder 16. When this occurs, the upper plate cylinder 12, upper blanket cylinder 13 and the lower blanket cylinder 16 move downwardly together toward the lower plate cylinder 15 against the combined influence of the swing assemblies 48 for the three printing cylinders.

When the bearers 29 for the lower blanket cylinder 16 engage the bearers 29 for the lower plate cylinder 15, downward movement of the printing cylinders 12, 13 and 16 is interrupted and the printing cylinders are in their thrown on or printing conditions shown in FIGS. 1 and 2. It should be noted that at this time, the extension on the swing arm 33 for the lower blanket cylinder 16 is spaced a relatively small distance from the stop 49 (see FIG. 2) while the extension for the swing arm 36 of the upper blanket cylinder 13 is spaced a somewhat larger distance from its stop 49. Similarly, the extension 42 for the swing arm 39 of the upper plate cylinder 12 is spaced still further from its stop 49. This is because in moving from their thrown off positions (FIG. 3) to their printing positions, the upper plate cylinder 12 travels further than the upper blanket cylinder 13 and the upper blanket cylinder 13 travels further than the lower blanket cylinder 16.

During movement of the printing cylinders 12, 13 and 16 from their thrown off positions (FIG. 3) to their printing positions (FIG. 2), the printing cylinders pivot about central axes of the pins 34, 37 and 40 which extend parallel to the central axes of the cylinders. It should be noted that the axes of the pivot pins 34, 37 and 40 are disposed outside of the spatial envelope enclosed by the outer side surfaces of the associated printing cylinders.

It is to be understood that the forms of the invention herewith shown and described are to be taken as illustrative embodiments only of the same, and that various changes in the shape, size and arrangement of the parts may be resorted to without departing from the spirit of the invention.

Having described specific preferred embodiments of the invention, the following is claimed:

1. A printing press for printing on material, said printing press including a plurality of movable printing cylinders, a pair of bearers connected with each of said Printing cylinders, each of said bearers being disposed adjacent to an axial end portion of a printing cylinder, a plurality of support means for supporting said printing cylinders for movement between a thrown off position in which the bearers of each printing cylinder are separated from the bearers of an adjacent printing cylinder and a printing position in which the bearers of each printing cylinder are in abutting engagement with the bearers of an adjacent printing cylinder, a plurality of spring means each of which is associated with one of said printing cylinders to urge the associated printing cylinder to its thrown off position, and motor means for moving said printing cylinders from their thrown off positions to their printing positions against the influence of said spring means, said motor means being operable to apply force directly to a first of said printing cylinders to move said first printing cylinder to its printing position, each of the printing cylinders other than said first printing cylinder being movable from its thrown off position to its printing position against the influence of the associated one of said spring means under the influence of forces transmitted directly to the bearers of each of the other printing cylinders from the bearers of an adjacnet printing cylinder upon operation of said motor means, each of said support means including a pair of pivotal arms connected with opposite end portions of a respective one of said printing cylinders and pivot means for supporting said arms for pivotal movement about an axis offset to one side of the printing cylinder to which the arms are connected, each of said spring means being engageable with one of said arms to urge said one of said arms to pivot toward a position in which the printing cylinder connected with said one of said arms is in its thrown off position.

2. A printing press as set forth in claim 1 further comprising a plurality of stop means each of which is associated with a respective one of said printing cylinders to limit the throw off position of said respective one cylinder.

3. A printing press as set forth in claim 1 wherein each of said plurality of stop means is adjustable.

4. A printing press as set forth in claim 1 wherein each of said spring means includes a tubular bracket fixed to the press frame and a compression spring located in said bracket and acting on a respective pivotal arm.

5. A printing press as set forth in claim 4 wherein each of said spring means comprises means for adjusting the force applied by said compression spring to said respective pivotal arm.

6. A printing press for printing on material, said printing press including a plurality of movable printing cylinders, a pair of bearers connected with each of said printing cylinders, each of said bearers being disposed adjacent to an axial end portion of a printing cylinder, a plurality of support means for supporting said printing cylinders for movement between a thrown off position in which the bearers of each printing cylinder are separated from the bearers of an adjacent printing cylinder and a printing position in which the bearers of each printing cylinder are in abutting engagement with the bearers of an adjacent printing cylinder, a plurality of spring means each of which is associated with one of said printing cylinders to urge the associated printing cylinder to its thrown off position, and motor means for moving said printing cylinders from their thrown off positions to their printing positions against the influence of said spring means, said motor means being operable to apply force directly to a first of said printing cylinders to move said first printing cylinder to its printing position, each of the printing cylinders other than said first printing cylinder being movable from its thrown off position to its printing position against the influence of the associated one of said spring means under the influence of forces transmitted directly to the bearers of each of the other printing cylinders from the bearers of an adjacent printing cylinder upon operation of said motor means, each of said support means and each of said spring means includes a pair of cantilevered leaf springs having free end portions connected with opposite end portions of one of said printing cylinders and fixed end portions, each pair of cantilevered leaf springs being effective to support said one of said printing cylinders in its thrown off position, said motor means being operable to effect movement of each of said printing cylinders against the influence of a biasing force applied to each of said printing cylinders by one of said pairs of cantilevered leaf springs.

* * * * *